United States Patent [19]

Whitney

[11] Patent Number: 4,557,381

[45] Date of Patent: Dec. 10, 1985

[54] WRAP FOR IMPREGNATED DRESSING

[75] Inventor: William G. Whitney, Evanston, Ill.

[73] Assignee: Alba-Waldensian, Inc., Valdese, N.C.

[21] Appl. No.: 530,662

[22] Filed: Sep. 9, 1983

[51] Int. Cl.[4] ..... B65D 83/00; B65D 75/00

[52] U.S. Cl. ..... 206/440; 206/210; 206/438; 206/812

[58] Field of Search ..... 206/210, 440, 438, 441, 206/812, 63.3

[56] References Cited

U.S. PATENT DOCUMENTS

| | | | |
|---|---|---|---|
| 2,752,038 | 6/1956 | Abbott | 206/441 |
| 2,954,116 | 9/1960 | Maso et al. | 206/440 |
| 2,969,145 | 1/1961 | Hannauer, Jr. | 206/441 |
| 3,017,990 | 1/1962 | Singerman | 206/440 |
| 3,062,371 | 11/1962 | Patience | 206/440 |
| 3,221,873 | 12/1965 | Bowes et al. | 206/63.3 |
| 3,344,915 | 10/1967 | Rawlings | 206/440 |
| 3,491,753 | 1/1970 | Milton et al. | 206/440 |
| 3,534,887 | 10/1970 | Ginsberg | 206/812 |
| 4,332,319 | 6/1982 | Hurwood | 206/210 |
| 4,427,111 | 1/1984 | Laipply | 206/210 |

*Primary Examiner*—William T. Dixson, Jr.
*Assistant Examiner*—Brenda J. Ehrhardt
*Attorney, Agent, or Firm*—Hill, Van Santen, Steadman & Simpson

[57] ABSTRACT

A wrap for receiving and surrounding an impregnated dressing to prevent it from sticking to a foil pouch in which the wrap and dressing are received characterized by a sheet-like member folded to form first and second panels having flaps on an edge opposite said fold line to enable easy opening of the wrap to expose the dressing. Preferably, the wrap is formed of a material such as paper which enables opening of the wrap to release the dressing without damaging or distorting the dressing.

6 Claims, 6 Drawing Figures

WRAP FOR IMPREGNATED DRESSING

BACKGROUND OF THE INVENTION

The present invention is directed to a wrap formed of sheet paper, which is folded around an impregnated gauze dressing to maintain the sterility and makes it easier for hospital personnel to handle the dressing. The invention is also directed to a package for the dressing, which package includes the wrap as an inner wrap for holding the dressing which wrap is received in an outer sealed pouch of aluminum foil.

A dressing, that is often used in hospitals for covering a wound or a skin graft area, is a petrolatum dressing which comprises a fine-mesh gauze which is coated with petrolatum. Petrolatum is a well known commercially available material and an example is sold under the trademark "VASELINE". It is necessary that the dressing be sterile but because of the oily nature of the material, it is difficult to sterilize this dressing in the hospital with the sterilizers which are available. Therefore, the best method has been to have the impregnated dressing prepared commercially and packaged for the hospital.

The most satisfactory method found to date for preparing the dressing commercially involves placing the dressing in an aluminum foil pouch which is sealed on all four edges and steam sterilized. When the pouch reaches the sterilization temperature which is approximately 250° F., the petrolaum melts and adheres to the foil so that when the pouch is later opened, part of the petrolatum is left behind on the foil. In addition, the dressing will stick to the inside surfaces of the foil of the pouch when the pouch is opened and thus this sticking to the foil pouch will cause the dressing to become twisted and/or difficult to handle.

In addition, when it is desired to use the dressing in surgery or in other sterile environments and since the dressing cannot be easily removed from the foil pouch and placed on a sterile field until it is ready to be used, it is necessary to enclose the foil pouch within a second outer wrapper, usually a paper-type wrap. This entire package is then sterilized so that the outside of the foil pouch is also sterile and can be placed on the sterile field in the operating room by removing the outer paper wrapper and dropping the foil pouch thereon. When the dressing is needed, it then can be opened by the sterile nurse with her gloved hands. However, as mentioned hereinabove, when the pouch is opened by the sterile nurse, difficulties with twisting and/or unwrapping of the dressing because of its sticking to the pouch will occur.

SUMMARY OF THE INVENTION

The present invention is directed to a wrap for an impregnated dressing which wrap enables protecting the dressing and easy handling of the dressing during dispensing without causing twisting or damage thereto. The wrap which receives and surrounds the sterile impregnated gauze dressing comprises a one-piece folded sheet member having a front panel or portion connected by a fold line to a back panel or portion, the front and back portions receive and surround the dressing and said front and back panels having means for enabling easy opening of the portions to remove the dressing from the wrap. Preferably, the wrap is an inner wrap which is inserted in an aluminum foil outer pouch which is sealed around the inner wrap and sterilized in a conventional manner.

The wrap is formed of a sheet of material such as paper which is both oil and water-resistant and will withstand the rigors of steam sterilization. In addition, the paper-like material will stick to the impregnated dressing, however, the adhesion between the dressing and the material is less than the adhesion between the layers of the dressing so that when the front and back panels or portions are opened up, the sterile dressing can be easily removed without becoming tangled or unwrapped. As mentioned, paper has been found ideal as a material for forming the wrap and also plastic film such as polypropylene films have been used.

Preferably, the means to enable easy opening comprises a second fold adjacent a free edge of one of the front or back panels to form a flap. Preferably, the second fold extends along the length of the free edge that enables gripping both a portion of the front panel and an exposed portion of the back panel to open up the wrap.

DESCRIPTION OF THE PREFERRED EMBODIMENTS

Figure 2:
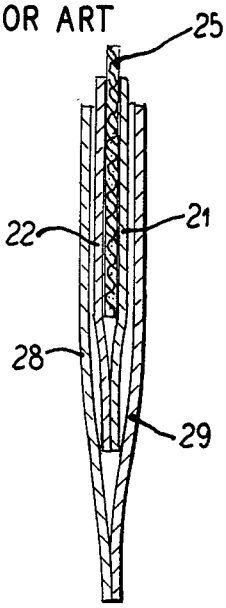
FIG. 2 PRIOR ART
FIG. 2 is a partial cross-sectional view taken along lines II—II of FIG. 1.
Figure 5:
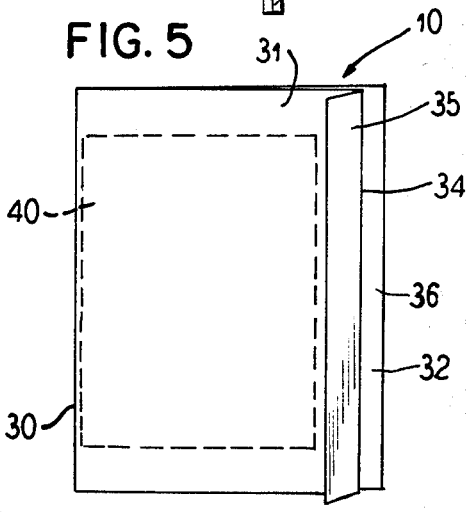
FIG. 5 is a perspective view of a wrap according to the present invention.
Figure 3:
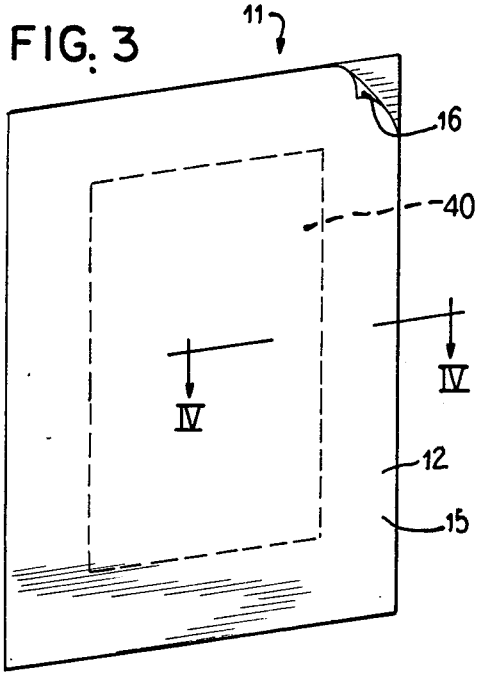
FIG. 3 is a perspective view of a package in accordance with the present invention.
Figure 4:
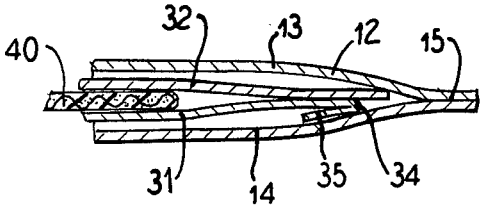
FIG. 4 is a partial cross-section taken along the lines IV—IV of FIG. 3.

The principles of the present invention are particularly useful in an inner wrap generally indicated at 10 in FIG. 5 which is used in an improved package which is generally indicated at 11 in FIG. 3. The package 11 includes an outer sealed aluminum pouch 12, which as best illustrated in FIG. 4 includes two sheets 13 and 14 which are sealed together along all four edges such as the edge 15 in FIG. 4 and having a corner tab 16 to aid in opening the pouch. The two sheets 13 and 14 of aluminum foil are sealed in a conventional manner which is known and utilized in a prior art package such as illustrated by the package 20 of FIGS. 1 and 2.

Figure 1:
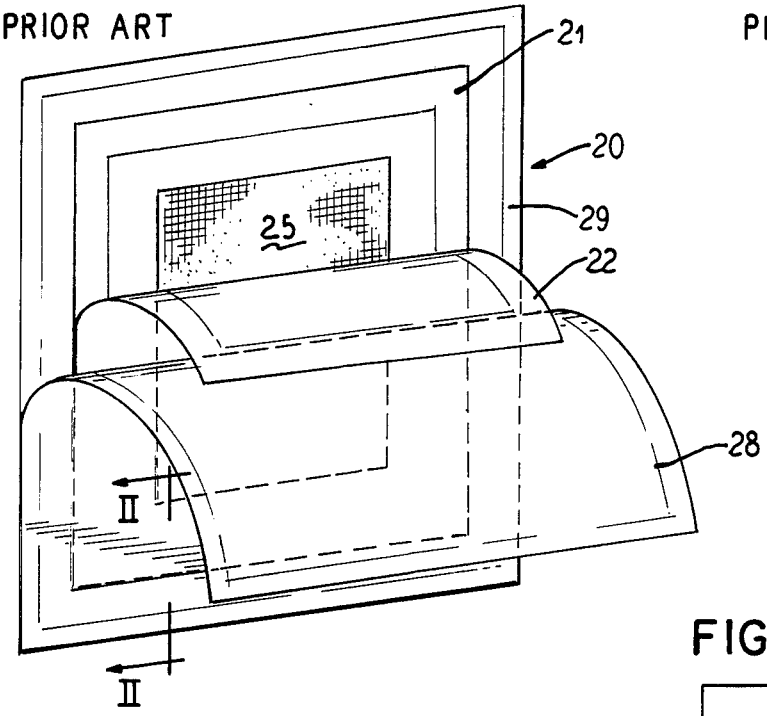
FIG. 1 PRIOR ART
FIG. 1 is a perspective view of a prior art package for an impregnated dressing with portions of the package being partially opened.

The prior art package 20 as mentioned hereinbefore comprises a pouch formed of aluminum foil sheets 21 and 22 which are sealed on all four edges to receive and surround a petrolatum impregnated gauze dressing 25. As mentioned, the sterilized aluminum foil pouch was contained in an outer paper wrapper which was composed of two sheets 28 and 29 which have their edges sealed together as best illustrated in FIG. 2. As mentioned hereinabove, the aluminum pouch composed of sealed-together sheets 21 and 22 were removed from the outer wrapping formed by the paper sheets 28 and 29 and deposited on a sterile field in an operating room. Subsequently, a sterile nurse could remove the dressing 25 from the pouch. However, when the aluminum foil sheets such as 21 and 22 were pealed apart as illustrated in FIG. 1, there was a tendency for the impregnated dressing to stick to both sheets and become tangled and/or separated.

The wrap 10 of the present invention preferably comprises a single sheet member which is folded on a fold line 30 to form a front portion or panel 31 and a back portion or panel 32. As illustrated, the fold line 30 is preferably selected so that the front panel or portion 31 is slightly larger than the back portion 32. To provide means to enable opening the front and back portions, the front portion is provided with a second fold line 34 to form a tab or flap 35 and to expose an edge portion 36 of the back panel 32. As illustrated, the fold line 34 runs substantially parallel to the fold line 30 so that the flap 35 extends the length of the front panel or portion 31. However, the second fold 34 could be adjacent one of the corners and extend at an angle to the first fold line 30 to create a triangular tab in one of the corners.

Figure 6:
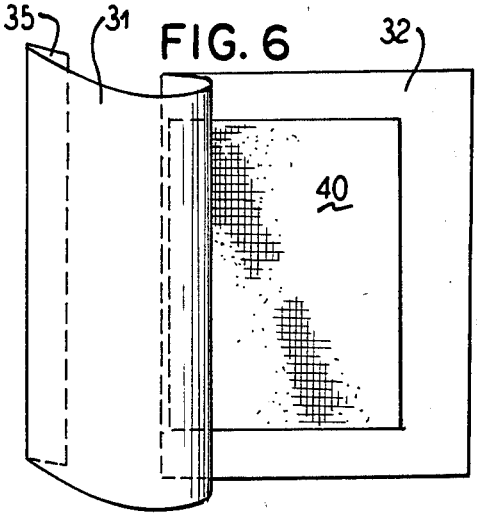
FIG. 6 is a perspective view of the wrap in an open position exposing the dressing contained therein.

As best illustrated in FIG. 6, an opening of the front panel 31 from the back panel or portion 32 exposes the sterile dressing 40 which may be the same structure as the dressing 25 in the prior art package.

As pointed out hereinabove, the second fold line 34 provides the short flap 35 on the front portion or panel which can be grasped by the fingers of one hand while holding the extended portion or flap 36 of the back portion or panel 32 with the other hand. This allows the wrap to be opened without touching the dressing 40 or having either hand over the top of the dressing. This is considered a good sterile technique.

Since the dressing 40 is covered by the wrap 10 which is received in the foil pouch 12 of the package 11, the outer surfaces of the wrap 10 are sterile. Thus, the foil package 12 can be opened with the wrap 10 containing the dressing 40 being positioned or placed on a sterile field, for instance, in an operating room. Then, the dressing can be removed from the wrap as mentioned hereinabove. In addition, in a non-sterile environment, the wrap 10 can be removed from the foil pouch 12 of the package 11 by hand and laid on a non-sterile surface without contaminating the dressing 40.

The wrap 10, which can be considered an inner wrap when used in the package 11, can be made of a variety of foldable materials. For the dressing described, a relatively stiff paper of forty pounds or heavier is recommended and it must be a paper which is both oil and water-resistant and which will take the rigors of steam sterilization. In other words, a paper is selected which is oil-resistant at a temperature of approximately 250° F. By oil-resistant it means that the petrolatum will not leach through the paper. Water-resistant means that the water in the steam sterilization does not cause the paper to fall apart. It has been found that paper which is a forty pound weight is stiff enough to take and retain folds and act as a package. Instead of paper, a plastic film such as polypropylene have been used. Thus, paper has been found to be the easiest to use. Satisfactory results have been obtained with a commercially available paper which is described as a forty-five pound weight, oil and grease-resistant paper which is fluorocarbon treated white paper. Such paper is available from Knox & Schneider, Chicago, Illinois and carries their designation #45-OGR paper.

Another feature of paper is that it sticks to the petrolatum impregnated dressing 40 so that the pouch stays closed when it is removed from the foil pouch or wrapper 12. This protects the dressing when it is removed from the sterile package until it is ready to be used. However, the unique part is that the adhesion of the paper to the dressing is less than the adhesion between the layers of the dressing so that the dressing will stay intact when the wrapper is opened. In other words, when the front panel 31 and the back panel 32 are spread apart as illustrated in FIG. 6, the dressing 40 will remain intact without becoming tangled or distorted. This is in contrast to the previously available package such as illustrated by the prior art packages of FIGS. 1 and 2 wherein the dressing 25 stuck to both of the foil sheets of the pouch and when the pouch was opened, the dressing became tangled and difficult to handle due to its sticking to the peeled-back portions of the pouch.

To produce the package 11, the impregnated dressing 40 is placed in the wrap 10. The wrap 10 is then placed into a suitable aluminum foil pouch. The aluminum pouch containing the wrap 10 is then sealed and terminally sterilized in a conventional manner such as used in sealing the pouch of the prior art package 20. When ready for use by a medical person, the outer pouch 12 is opened in a sterile manner by peeling back the layers 13 and 14 to expose the wrap 10. When used in a sterile environment such as an operating room, the wrap 10 is removed from the pouch by using a sterile technique such as dropping the wrap 10 containing the dressing 40 onto a sterile field. When used in a non-sterile atmosphere such as a patient's bedside, the wrap 10 is simply grasped by the fingers of the personnel and removed from the opened pouch. The inner wrap is opened by grasping the flaps 35 and 36 to pull the front portion from the back portion with the dressing sticking to one of the two portions. Because of the unique adhering qualities of the paper to the dressing, the dressing will adhere only to one of the two portions but not both so that it may be easily removed from the wrap 10 without becoming tangled or disrupted.

Although various minor modifications may be suggested by those versed in the art, it should be understood that I wish to embody within the scope of the patent granted hereon, all such modifications as reasonably and properly come within the scope of my contribution to the art.

I claim:

1. A package for a sterile gauze dressing which is impregnated with a moist material, said package comprising an inner wrap for receiving and surrounding the dressing, said inner wrap being a one-piece sheet member having a first fold line to form a back panel and a front panel and said inner wrap having means for enabling easy opening of the front and back panels to remove the dressing therefrom, said means including a second fold line in one of the two panels adjacent a free edge thereof to form a flap with an area of the other panel of the two panels being exposed to form a second flap, said sheet member being of a sheet material having a resistance to the moist material and having an adhesion for the dressing which is less than the adhesion between layers of the dressing so that with an opening of the wrap, the dressing remains on one of said panels without being damaged; and an outer pouch of aluminum foil sealed around the inner wrap and dressing to maintain a sterile condition of said dressing and inner wrap, said outer pouch being composed of two sheets of material being sealed together adjacent each edge with tab means adjacent at least one edge to enable peeling of the two sheets apart to gain easy access to the inner wrap.

2. A package according to claim 1, wherein said second fold line extends parallel to the first fold line so that the flaps extend the length of the wrap.

3. A package according to claim 1, wherein the sheet member is a sheet of paper.

4. A package for a sterile gauze dressing, which is impregnated with moist material, said package comprising an inner wrap for receiving and surrounding the dressing and an outer pouch sealed around the inner wrap and dressing to maintain a sterile condition of said dressing and inner wrap, said outer pouch being composed of two sheets of material being sealed together along each edge with tab means adjacent at least one edge to enable peeling the two sheets apart to gain easy access to the inner wrap, said inner wrap being a one-piece sheet member having a fold line to form a back panel and a front panel and said inner wrap having means for enabling easy opening of the front and back panels to remove the dressing therefrom, said means including a second fold line in one of the two panels adjacent a free edge thereof to form a flap with an area of the other panel of the two panels being exposed to form another flap, and said sheet member being of a material having a resistance to the moist material and having an adhesion for the dressing which is less than the adhesion between layers of the dressing so that with an opening of wrap, the dressing remains on one of said two panels without damaging the dressing.

5. A package according to claim 1, wherein said second fold extends parallel to the first fold.

6. A package according to claim 4, wherein the one-piece sheet member is a sheet of paper.

* * * * *